United States Patent [19]

Eylon et al.

[11] Patent Number: 5,032,189

[45] Date of Patent: Jul. 16, 1991

[54] METHOD FOR REFINING THE MICROSTRUCTURE OF BETA PROCESSED INGOT METALLURGY TITANIUM ALLOY ARTICLES

[75] Inventors: Daniel Eylon, Dayton, Ohio; Francis H. Froes, Moscow, Id.

[73] Assignee: The United States of America as represented by the Secretary of the Air Force, Washington, D.C.

[21] Appl. No.: 498,881

[22] Filed: Mar. 26, 1990

[51] Int. Cl.[5] ..... C22F 1/18

[52] U.S. Cl. ..... 148/11.5 F; 148/12.7 B; 148/407; 148/421; 420/420

[58] Field of Search ..... 148/11.5 F, 12.7 B, 148/407, 421

[56] References Cited

U.S. PATENT DOCUMENTS

| | | | |
|---|---|---|---|
| 4,543,132 | 9/1985 | Berczik et al. | 148/421 |
| 4,842,652 | 6/1989 | Smith et al. | 148/12.7 B |
| 4,854,977 | 8/1989 | Alheritiere et al. | 148/12.7 B |
| 4,902,355 | 2/1990 | Jaffee et al. | 148/11.5 F |

FOREIGN PATENT DOCUMENTS

| | | | |
|---|---|---|---|
| 3230857 | 9/1988 | Japan | 148/11.5 F |
| 3230858 | 9/1988 | Japan | 148/11.5 F |
| 3259060 | 10/1988 | Japan | 148/11.5 F |

*Primary Examiner*—Upendra Roy

*Attorney, Agent, or Firm*—Charles E. Bricker; Donald J. Singer

[57] ABSTRACT

Near-alpha and alpha+beta titanium alloy components are produced by a process which comprises the steps of forging an alloy billet to a desired shape at a temperature at or above the beta-transus temperature of the alloy to provide a forged component, heat treating the forged component at a temperature approximately equal to the beta-transus temperature of the alloy, cooling the component at a rate in excess of air cooling to room temperature, annealing the component at a temperature in the approximate range of 10 to 20% below said beta-transus temperature for about 4 to 36 hours, and air cooling the component to room temperature.

4 Claims, 2 Drawing Sheets

METHOD FOR REFINING THE MICROSTRUCTURE OF BETA PROCESSED INGOT METALLURGY TITANIUM ALLOY ARTICLES

RIGHTS OF THE GOVERNMENT

The invention described herein may be manufactured and used by or for the Government of the U.S. for all governmental purposes without the payment of any royalty.

BACKGROUND OF THE INVENTION

This invention relates to the processing of forged titanium articles to improve the microstructure of such articles.

High strength titanium alloys are widely used in aerospace applications. Considerable research has been directed toward increasing strength and fatigue properties of titanium alloy airframe components.

Due to the nature of titanium transformation and alloying stabilization behavior, titanium grades can be grouped into three major classes, depending on the phase or phases present in their microstructures. These are alpha/near-alpha, alpha+beta, and near-beta/beta types.

Most titanium alloys currently used for high performance aerospace applications are alpha+beta (e.g., Ti-6Al-4V) and near-alpha (e.g., Ti-6Al-2Sn-4Zr 2Mo) alloys. Commercial emphasis for the manufacture of these alloy forgings has been largely placed on the alpha+beta processings to assure adequate strength and ductility. Alpha+beta alloys are the most commonly used titanium alloys and are designed for intermediate strength and high fracture resistance in both airframe and engine applications. Near-alpha alloys possess excellent high temperature properties and are generally designed for high creep properties at high temperatures. Because of lack of toughness in the solution treated and aged condition and relatively poor hardenability, alpha+beta alloys have commonly been used in the annealed condition. As a result, the strength capability of titanium alloys cannot be effectively utilized.

Forging of near-alpha or alpha+beta titanium alloys is one of the most common methods for producing high integrity components for fatigue-critical airframe and gas turbine engine applications. Currently, forging of these classes of alloys is done at temperatures below the beta transus temperature of the alloys because the microstructures developed have a good combination of tensile and fatigue properties. On the other hand, forging near or above the beta transus temperature provides certain advantages in terms of reduced press load and much better shape definition, since the alloy plastic flow resistance is greatly reduced. Unfortunately, the microstructure developed as a result of such forging is a lenticular beta microstructure which is inferior in terms of fatigue performance.

What is desired is a method for forging near-alpha or alpha+beta titanium alloys which will reduce press load and provide better shape definition, thereby reducing cost, and which will provide forgings having a fatigue-resistant microstructure.

Accordingly, it is an object of the present invention to provide an improved process for forging near-alpha and alpha+beta titanium alloy components.

Other objects, aspects and advantages of the present invention will become apparent to those skilled in the art from a reading of the following detailed description of the invention.

SUMMARY OF THE INVENTION

In accordance with the present invention there is provided an improved process for fabricating forged near-alpha and alpha+beta titanium alloy components which comprises the steps of:

a. forging a near-alpha or alpha+beta titanium alloy at a temperature at or above the beta-transus temperature of the alloy to provide a forged article;
b. beta-solution heat treating the forged article for a relatively brief time;
c. cooling the article at a rate in excess of the air cooling rate;
d. aging the article at a suitable temperature below the beta-transus for a suitable time; and
e. air cooling the article to room temperature.

The resulting structure comprises a fine lamellar alpha structure in a matrix of discontinuous beta phase.

DETAILED DESCRIPTION OF THE INVENTION

The present invention is directed to a process for providing improved properties in titanium alloys. The invention was developed with respect to the alpha+-beta alloy Ti-6Al-4V and will be described with respect to this alloy. The invention is useful for processing the series of titanium alloys known as near-alpha and alpha+beta alloys. Examples of near-alpha titanium alloys include Ti-8Al-lMo-1V and Ti-6Al-2Sn-4Zr-2Mo. Examples of alpha+beta titanium alloys include Ti-6Al-4V, Ti-6Al-6V-2Sn, Ti-6Al-2Sn-4Zr-6Mo and Ti-5Al-2Sn-2Zr-4Mo-4Cr.

The first step of the process of this invention is a forging step, carried out at a temperature in the hot working regime of the alloy, preferably about 0°-200° F. above the beta-transus temperature of the alloy. Isothermal forging, with allowance for reasonable temperature variations in the dies, i.e., up to about 20° C., is presently preferred.

Following the forging step, the component is beta-solution heat treated. Such treatment is accomplished by heating the component to approximately the beta-transus temperature of the alloy, i.e., from about 4% below to about 10% above the beta-transus temperature (in ° C.), followed by rapid cooling to obtain a martensitic-like structure. The period of time at which the component is held at or near the beta-transus temperature can vary from about 5 minutes to about 4 hours, depending upon the cross-section of the component. The component is then rapidly cooled. Cooling may require water or oil quenching for large parts whereas static, forced air or gas cooling may be adequate for small parts. The forging is then aged by heating to about 10 to 20 percent below the beta-transus temperature for about 4 to 36 hours, followed by air cooling to room temperature.

Figure 1:
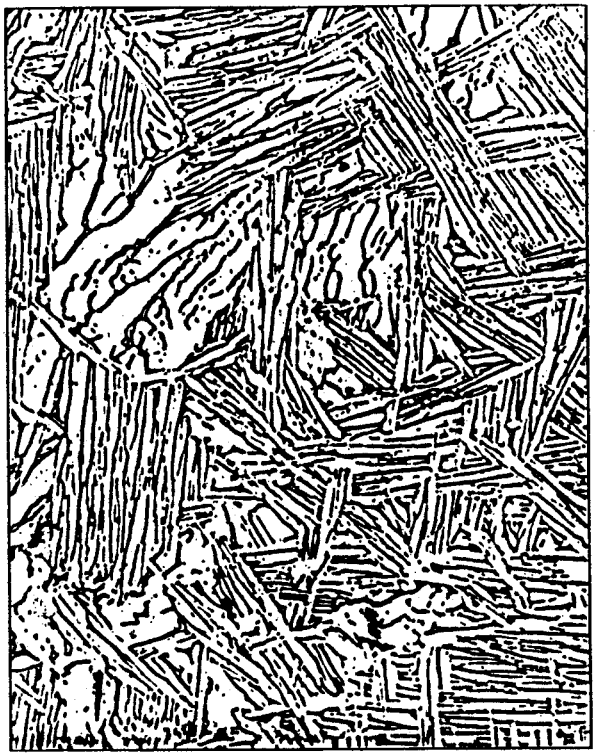
FIG. 1 is a 600x photomicrograph of Ti-6Al-4V forged at temperature at or above the beta-transus temperature of about 1800° F.
Figure 2:
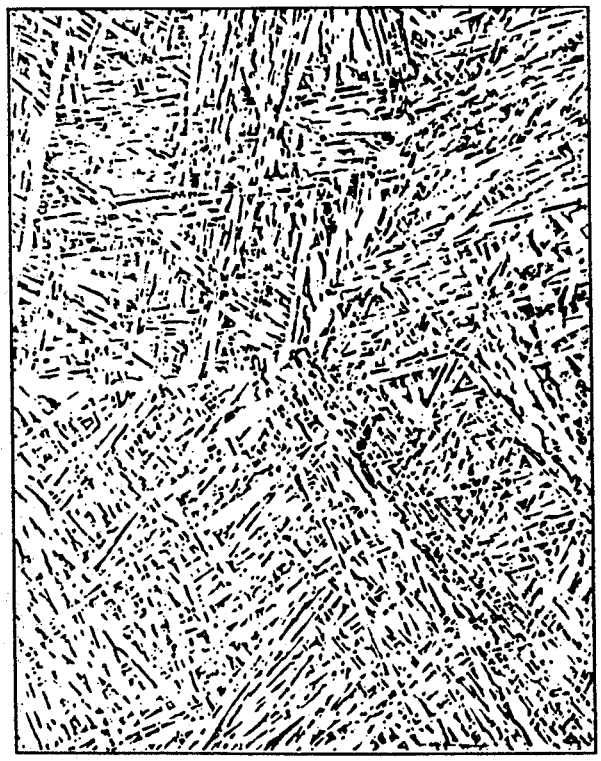
FIG. 2 is a 600x photomicrograph of a Ti-6Al-4V specimen processed according to the present invention.
Figure 3:
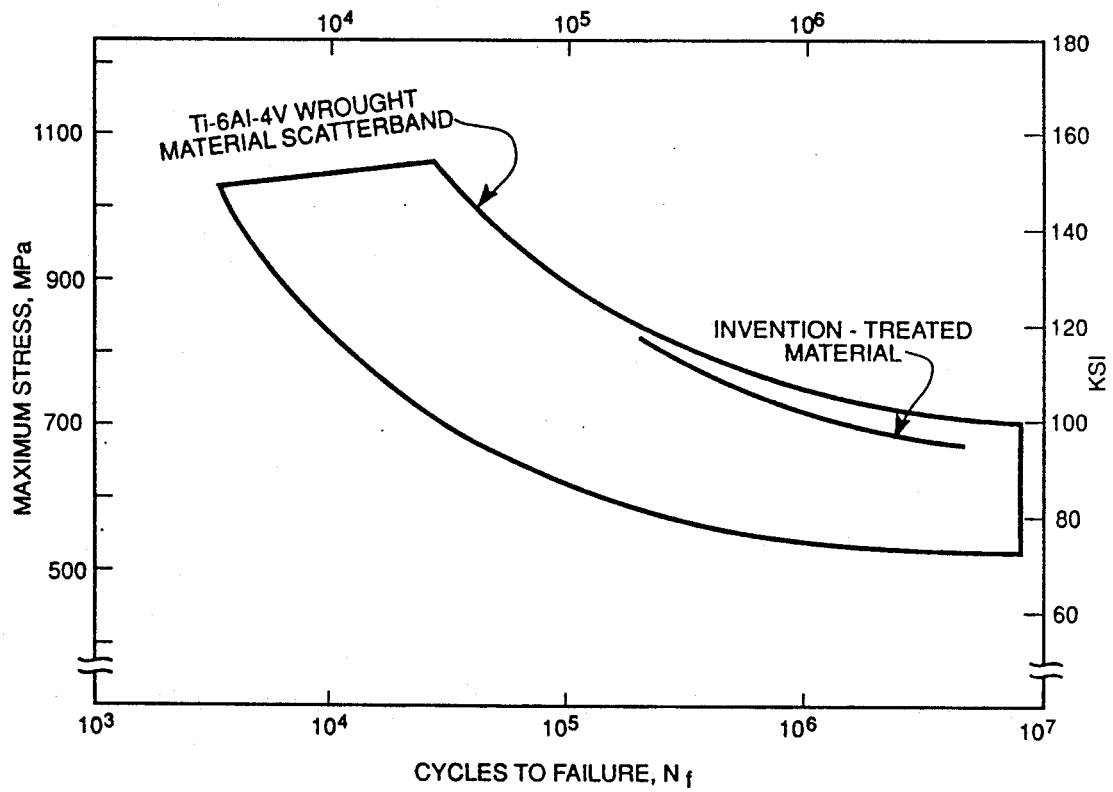
FIG. 3 illustrates the smooth axial fatigue strength of specimens treated according to the invention compared to the scatterband of mill annealed wrought material.

The benefits of the method of this invention are illustrated in FIGS. 1–3. A typical microstructure of a specimen of Ti-6Al-4V forged at or above the beta-transus temperature is shown in FIG. 1. The lenticular, beta-processed microstructure is a mixture of high aspect ratio alpha lamelae separated by a small amount of intergranular beta.

FIG. 2 illustrates a structure resulting from treatment in accordance with the present invention. The structure consists of fine lamellar alpha in a matrix of discontinuous beta.

FIG. 3 illustrates the smooth axial fatigue strength of a series of wrought specimens processed as described above compared to the scatterband of mill annealed wrought material. It can be seen that the fatigue results of material processed in accordance with the invention are equal to the best results obtained from ingot metallurgy processed material which was forged or worked in the alpha+beta phase field.

The method of this invention is generally applicable to the manufacture of aircraft components, as well as non-aerospace components. In particular, this invention provides for fabrication by forging of net-shape components having a desired fatigue-resistant microstructure.

Various modifications may be made to the present invention without departing from the spirit and scope of the invention.

We claim:

1. A process for fabricating forged near-alpha and alpha+beta titanium alloy components which comprises the steps of (a) forging a near-alpha or alpha+beta titanium alloy billet to a desired shape at a temperature at or above the beta-transus temperature of the alloy to provide a forged component;

(b) heat treating the forged component at a temperature approximately equal to the beta-transus temperature of the alloy;

(c) cooling said component at a rate in excess of air cooling to room temperature;

(d) annealing said component at a temperature in the approximate range of 10 to 20% below said beta-transus temperature for about 4 to 36 hours; and (e) air cooling said component to room temperature.

2. The process of claim 1 wherein said heat treating step (b) is carried out at a temperature ranging from about 5% below to about 10% above said beta-transus temperature for about 10 to 240 minutes.

3. The process of claim 1 wherein said heat treating step (b) is carried out at a temperature ranging from about 0% to 5% above said beta-transus temperature for about 10 to 240 minutes.

4. The process of claim 1 wherein said alloy is Ti-6Al-4V, and wherein said heat treating step (b) is carried out at about 1025° C. for about 20 minutes followed by water quenching.

* * * * *